US009957690B2

(12) United States Patent
Colwell et al.

(10) Patent No.: US 9,957,690 B2
(45) **Date of Patent: *May 1, 2018**

(54) CONTROLLING A DIGGING OPERATION OF AN INDUSTRIAL MACHINE

(71) Applicant: Harnischfeger Technologies, Inc., Wilmington, DE (US)

(72) Inventors: Joseph Colwell, Hubertus, WI (US); William Powers, Mukwonago, WI (US); John Burant, Waukesha, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/237,053

(22) Filed: Aug. 15, 2016

(65) Prior Publication Data

US 2016/0348337 A1 Dec. 1, 2016

Related U.S. Application Data

(63) Continuation of application No. 14/695,725, filed on Apr. 24, 2015, now Pat. No. 9,416,517, which is a (Continued)

(51) Int. Cl.

*E02F 3/43* (2006.01)
*E02F 3/30* (2006.01)

(Continued)

(52) U.S. Cl.

CPC ..... *E02F 3/431* (2013.01); *E02F 3/304* (2013.01); *E02F 3/308* (2013.01); *E02F 3/352* (2013.01);

(Continued)

(58) Field of Classification Search

CPC . E02F 3/431; E02F 3/304; E02F 3/308; E02F 3/43; E02F 3/432; E02F 3/435;

(Continued)

(56) References Cited

U.S. PATENT DOCUMENTS 3,207,339 A 9/1965 Neslin
3,518,444 A 6/1970 Barber (Continued)

FOREIGN PATENT DOCUMENTS

AU 5826586 1/1987
CL 47243 6/1995

(Continued)

OTHER PUBLICATIONS

First Office Action from the Chilean Intellectual Property Office for Application No. 003118-2013 dated Jan. 13, 2017 (12 pages, which includes Statement of Relevance).

(Continued)

*Primary Examiner* — Marthe Y Marc-Coleman
(74) *Attorney, Agent, or Firm* — Michael Best & Friedrich LLP

(57) ABSTRACT

Systems, methods, devices, and computer readable media for controlling the operation of an industrial machine including one or more components. A method of controlling the industrial machine includes determining a position of at least one of the one or more components of the industrial machine during a digging operation, determining a hoist bail pull setting based on the position of the at least one of the one or more components and a relationship between component position and hoist bail pull, and setting a level of hoist bail pull to the hoist bail pull setting. The level of hoist bail pull early in the digging operation is greater than the level of hoist bail pull later in the digging operation.

25 Claims, 8 Drawing Sheets

Related U.S. Application Data continuation of application No. 14/224,218, filed on Mar. 25, 2014, now Pat. No. 9,080,316, which is a continuation of application No. 13/959,921, filed on Aug. 6, 2013, now Pat. No. 8,682,542, which is a continuation of application No. 13/222,939, filed on Aug. 31, 2011, now Pat. No. 8,504,255.

(60) Provisional application No. 61/480,603, filed on Apr. 29, 2011.

(51) Int. Cl.

| | |
|---|---|
| ***E02F 3/46*** | (2006.01) |
| ***E02F 9/20*** | (2006.01) |
| ***E02F 9/26*** | (2006.01) |
| ***E02F 5/02*** | (2006.01) |
| ***E02F 3/352*** | (2006.01) |

(52) U.S. Cl.

CPC ..... *E02F 3/43* (2013.01); *E02F 3/432* (2013.01); *E02F 3/435* (2013.01); *E02F 3/46* (2013.01); *E02F 5/025* (2013.01); *E02F 9/2025* (2013.01); *E02F 9/2029* (2013.01); *E02F 9/26* (2013.01); *E02F 9/265* (2013.01)

(58) Field of Classification Search

CPC . E02F 3/46; E02F 5/025; E02F 9/2025; E02F 9/2029; E02F 9/26; E02F 9/265

USPC ..... 701/50

See application file for complete search history.

(56) References Cited

U.S. PATENT DOCUMENTS

| | | | |
|---|---|---|---|
| 3,586,184 | A | 6/1971 | Pesavento et al. |
| 3,934,126 | A | 1/1976 | Zalesov et al. |
| 4,308,489 | A | 12/1981 | Bergmann |
| 4,358,719 | A | 11/1982 | Currier et al. |
| 4,677,549 | A | 6/1987 | Katsura et al. |
| 5,321,637 | A | 6/1994 | Anderson et al. |
| 5,363,304 | A | 11/1994 | Awano et al. |
| 5,408,767 | A | 4/1995 | Hazama et al. |
| 5,461,803 | A | 10/1995 | Rocke |
| 5,974,352 | A | 10/1999 | Shull |
| 6,025,686 | A | 2/2000 | Wickert et al. |
| 6,225,574 | B1 | 5/2001 | Chang et al. |
| 6,466,850 | B1 | 10/2002 | Hilgart |
| 6,691,010 | B1 | 2/2004 | Gay |
| 6,948,783 | B2 | 9/2005 | Hoff |
| 6,989,640 | B2 | 1/2006 | Yoshimatsu |
| 7,069,673 | B2 | 7/2006 | Kagoshima et al. |
| 7,152,349 | B1 | 12/2006 | Rowlands |
| 7,472,009 | B2 | 12/2008 | Baldwin |
| RE40,869 | E | 8/2009 | Leslie et al. |
| 7,658,234 | B2 | 2/2010 | Brandt et al. |
| 7,689,394 | B2 | 3/2010 | Furem et al. |
| 7,734,397 | B2 | 6/2010 | Peterson et al. |
| 7,832,126 | B2 | 11/2010 | Koellner et al. |
| 7,908,928 | B2 | 3/2011 | Vik et al. |
| 8,156,048 | B2 | 4/2012 | Mintah et al. |
| 8,285,434 | B2 | 10/2012 | Yanagisawa et al. |
| 8,468,816 | B2 | 6/2013 | Sora |
| 8,504,255 | B2 | 8/2013 | Colwell et al. |
| 8,682,542 | B2 | 3/2014 | Colwell et al. |
| 8,725,358 | B2 | 5/2014 | Takiguchi et al. |
| 8,739,906 | B2 | 6/2014 | Kawashima |
| 9,080,316 | B2 | 7/2015 | Colwell et al. |
| 2006/0124323 | A1 | 6/2006 | Glover et al. |
| 2007/0006492 | A1 | 1/2007 | Rowlands |
| 2007/0240341 | A1 | 10/2007 | Hyde |
| 2007/0266601 | A1 | 11/2007 | Claxton |
| 2009/0008351 | A1 | 1/2009 | Schneider et al. |
| 2009/0013810 | A1 | 1/2009 | Nakagawa et al. |
| 2009/0183397 | A1 | 7/2009 | Kubo et al. |
| 2009/0187527 | A1 | 7/2009 | McAree et al. |
| 2009/0238696 | A1 | 9/2009 | Satake et al. |
| 2011/0029279 | A1 | 2/2011 | McAree et al. |
| 2011/0088290 | A1 | 4/2011 | Rowlands |
| 2011/0106384 | A1 | 5/2011 | Corke et al. |
| 2011/0174907 | A1* | 7/2011 | Davis ..... B02C 23/02 241/101.74 |
| 2011/0233931 | A1 | 9/2011 | Weber et al. |
| 2013/0195595 | A1 | 8/2013 | Hottmann et al. |
| 2014/0025265 | A1 | 1/2014 | Taylor |

FOREIGN PATENT DOCUMENTS

| | | |
|---|---|---|
| CL | 42733 | 1/2000 |
| CL | 53134 | 10/2012 |
| CL | 201303119 | 10/2013 |
| CL | 201303120 | 10/2013 |
| CN | 1074965 | 8/1993 |
| CN | 101970763 | 2/2011 |
| CN | 102016186 | 4/2011 |
| JP | 6026067 | 2/1994 |
| RU | 2007109075 | 9/2008 |
| RU | 2361273 | 10/2009 |
| WO | 2009121122 | 10/2009 |
| WO | 2009152561 | 12/2009 |
| WO | 2011031851 | 3/2011 |

OTHER PUBLICATIONS

First Office Action from the Australian Intellectual Property Office for Application No. 2011366917 dated Aug. 7, 2015 (2 pages).

First Office Action from the State Intellectual Property Office of China for Application No. 201180071765.9 dated Mar. 13, 2015 (10 pages).

Second Office Action from the State Intellectual Property Office of China for Application No. 201180071765.9 dated Sep. 29, 2015 (6 pages).

PCT/US2011/050024 International Search Report and Written Opinion dated Apr. 10, 2012 (6 pages).

PCT/US2011/050024 International Preliminary Report on Patentability and Written Opinion dated Oct. 29, 2013 (6 pages).

Office Action from US Patent and Trademark Office for U.S. Appl. No. 13/222,939 dated Apr. 10, 2013 (11 pages).

Office Action from US Patent and Trademark Office for U.S. Appl. No. 13/959,921 dated Feb. 3, 2014 (6 pages).

Office Action from US Patent and Trademark Office for U.S. Appl. No. 14/224,218 dated Oct. 23, 2014 (7 pages).

Office Action from US Patent and Trademark Office for U.S. Appl. No. 14/224,218 dated May 27, 2015 (6 pages).

Office Action from the State Intellectual Property Office of China for Application No. 201410592121.X, Decision of Rejection, dated Mar. 6, 2017 (8 pages).

Bodur et al., "Dynamic Cognitive Force Control for an Automatic Land Excavation Robot," IEEE (1994) pp. 703-706.

Cannon et al., "Models for Automated Earthmoving," specification (first online: Apr. 30, 2008) 10 pages.

Dunbabin et al., "Autonomous Excavation Using a Rope Shovel," specification (2006) Field and Service Robotics, STAR 25, pp. 555-556.

Zhongpo et al., "The Reconfiguration Design of Redundant Thrust of Shields Excavating in Various Geologic Conditions," specification (2009) LNAI 5928, pp. 326-335.

Office Action from the Federal Service on Industrial Property for Application No. 2014138982 dated Sep. 21, 2016 (16 pages).

Chinese Patent Office Action for Application No. 201610230761.5 dated Sep. 7, 2017 (14 pages English translation included).

* cited by examiner

CONTROLLING A DIGGING OPERATION OF AN INDUSTRIAL MACHINE

RELATED APPLICATIONS

This application is a continuation of U.S. patent application Ser. No. 14/695,725, filed Apr. 24, 2015, now U.S. Pat. No. 9,416,517, which is a continuation of U.S. patent application Ser. No. 14/224,218, filed Mar. 25, 2014, now U.S. Pat. No. 9,080,316, which is a continuation of U.S. patent application Ser. No. 13/959,921, filed Aug. 6, 2013, now U.S. Pat. No. 8,682,542, which is a continuation of U.S. patent application Ser. No. 13/222,939, filed Aug. 31, 2011, now U.S. Pat. No. 8,504,255, which claims the benefit of U.S. Provisional Patent Application No. 61/480,603, filed Apr. 29, 2011, the entire contents of all of which are incorporated herein by reference.

BACKGROUND

This invention relates to controlling a digging operation of an industrial machine, such as an electric rope or power shovel.

SUMMARY

Industrial machines, such as electric rope or power shovels, draglines, etc., are used to execute digging operations to remove material from, for example, a bank of a mine. In difficult mining conditions, the degree to which the industrial machine is tipped in the forward direction impacts the structural fatigue that the industrial machine experiences. Limiting the maximum forward tipping moments and CG excursion of the industrial machine can thus increase the operational life of the industrial machine.

As such, the invention provides for the control of an industrial machine such that the hoisting force or hoist bail pull used during a digging operation is controlled to prevent increased or excessive forward tipping of the industrial machine. This is accomplished while increasing the productivity of the industrial machine by dynamically increasing the level of hoist bail pull low in a digging envelope of the digging operation. As the industrial machine continues through the digging operation and about the digging envelope, the controller gradually decreases the level of hoist bail pull from a maximum level to a lower or standard operational value. The level of hoist bail pull is reduced such that, late in the digging operation, the level of hoist bail pull has reached the standard operational value. Digging cycle time is correspondingly decreased by increasing hoist bail pull, payload low in the digging operation is increased, and the structural fatigue on the industrial machine is maintained at or below the level of an industrial machine without increased hoist bail pull.

In one embodiment, the invention provides a method of controlling a digging operation of an industrial machine. The industrial machine includes a dipper and a hoist motor drive or drives. The method includes determining a first position of the dipper with respect to a digging envelope, determining a first hoist bail pull setting based on the first position of the dipper and a relationship between dipper position and hoist bail pull, and setting a first level of hoist bail pull for the hoist motor drive to the first hoist bail pull setting. The method also includes determining a second position of the dipper with respect to the digging envelope, determining a second hoist bail pull setting based on the second position of the dipper and the relationship between dipper position and hoist bail pull, and setting a second level of hoist bail pull for the hoist motor drive to the second hoist bail pull setting. The first position of the dipper corresponds to a lower position in the digging envelope than the second position of the dipper, and the first level of hoist bail pull is greater than the second level of hoist bail pull.

In another embodiment, the invention provides an industrial machine that includes a dipper, a hoist motor drive, and a controller. The dipper is connected to one or more hoist ropes. The hoist motor drive is configured to provide one or more drive signals to a hoist motor, and the hoist motor is operable to apply a force to the one or more hoist ropes as the dipper is moved through a digging operation. The controller is connected to the hoist motor drive and is configured to determine a first position of the dipper associated with the digging operation, determine a first hoist bail pull setting based on a relationship between dipper position and hoist bail pull, and set a first level of hoist bail pull for the hoist motor drive to the first hoist bail pull setting. The controller is also configured to determine a second position of the dipper associated with the digging operation, determine a second hoist bail pull setting based on the relationship between dipper position and hoist bail pull, and set a second level of hoist bail pull for the hoist motor drive to the second hoist bail pull setting. The first position of the dipper corresponds to an earlier position in the digging operation than the second position of the dipper, and the first level of hoist bail pull is greater than the second level of hoist bail pull.

In another embodiment, the invention provides a method of controlling a digging operation of an industrial machine that includes one or more components. The method includes determining a position of at least one of the one or more components of the industrial machine during the digging operation, determining a hoist bail pull setting based on the position of at least one of the one or more components and a relationship between component position and hoist bail pull, and setting a level of hoist bail pull to the hoist bail pull setting. The level of hoist bail pull early in the digging operation is greater than the level of hoist bail pull later in the digging operation.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should be noted that a plurality of hardware and software based devices, as well as a plurality of different structural components may be utilized to implement the invention. Furthermore, and as described in subsequent paragraphs, the specific configurations illustrated in the drawings are intended to exemplify embodiments of the invention and that other alternative configurations are possible. The terms "processor" "central processing unit" and "CPU" are interchangeable unless otherwise stated. Where the terms "processor" or "central processing unit" or "CPU" are used as identifying a unit performing specific functions, it should be understood that, unless otherwise stated, those functions can be carried out by a single processor, or multiple processors arranged in any form, including parallel processors, serial processors, tandem processors or cloud processing/cloud computing configurations.

Other aspects of the invention will become apparent by consideration of the detailed description and accompanying drawings.

DETAILED DESCRIPTION

The invention described herein relates to systems, methods, devices, and computer readable media associated with the dynamic control of a hoisting force or hoist bail pull based on a position of, for example, a dipper, a dipper handle, or another component of an industrial machine. The industrial machine, such as an electric rope shovel or similar mining machine, is operable to execute a digging operation to remove a payload (i.e. material) from a bank. As the industrial machine is digging into the bank, the forces on the industrial machine caused by the extension of the dipper handle and the weight of the payload can produce a tipping moment and center-of-gravity ("CG") excursion on the industrial machine in the forward direction. The magnitude of the CG excursion is dependent, in part, on the applied level of hoist bail pull. In general, the greater the level of hoist bail pull, the greater the CG excursion in the forward direction. As a result of the CG excursion, the industrial machine experiences cyclical structural fatigue and stresses that can adversely affect the operational life of the industrial machine. In order to increase the productivity of the industrial machine without increasing the CG excursion experienced by the industrial machine, a controller of the industrial machine dynamically increases the level of hoist bail pull low in a digging envelope of the digging operation. As the industrial machine continues through the digging operation and about the digging envelope, the controller gradually decreases the level of hoist bail pull from a maximum level to a lower or standard operational value. The level of hoist bail pull is reduced such that, late in the digging operation, the level of hoist bail pull has reached, for example, the standard operational value or less than the standard operational value. Digging cycle time is correspondingly decreased, payload early in the digging operation and low in the digging envelope is increased, and the structural loading of the industrial machine is maintained at or below a level for a similar industrial machine that does not use increased hoist bail pull.

Figure 1:
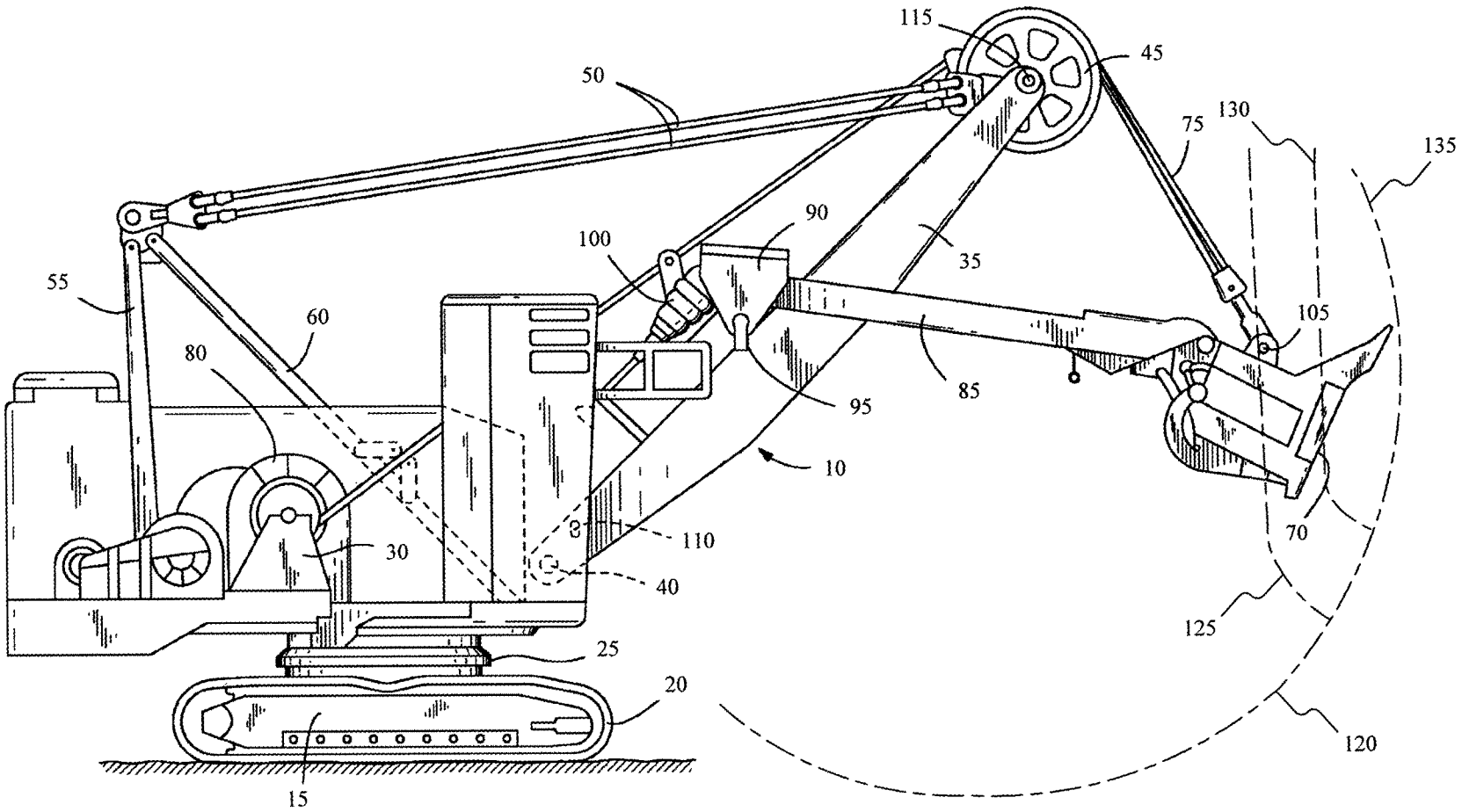
FIG. 1 illustrates an industrial machine according to an embodiment of the invention.

Although the invention described herein can be applied to, performed by, or used in conjunction with a variety of industrial machines (e.g., an electric rope shovel, a dragline, AC machines, DC machines, hydraulic machines, etc.), embodiments of the invention described herein are described with respect to an electric rope or power shovel, such as the power shovel 10 shown in FIG. 1. The shovel 10 includes a mobile base 15, drive tracks 20, a turntable 25, a machinery deck 30, a boom 35, a lower end 40, a sheave 45, tension cables 50, a back stay 55, a stay structure 60, a dipper 70, one or more hoist ropes 75, a winch drum 80, dipper arm or handle 85, a saddle block 90, a pivot point 95, a transmission unit 100, a bail pin 105, an inclinometer 110, and a sheave pin 115. In the illustrated embodiment, the shovel 10 also has a digging envelope 120 associated with a digging operation that is divided into three regions: an inner region 125 ("REGION-A"), a middle region 130 ("REGION-B"), and an outer region ("REGION-C").

The mobile base 15 is supported by the drive tracks 20. The mobile base 15 supports the turntable 25 and the machinery deck 30. The turntable 25 is capable of 360-degrees of rotation about the machinery deck 30 relative to the mobile base 15. The boom 35 is pivotally connected at the lower end 40 to the machinery deck 30. The boom 35 is held in an upwardly and outwardly extending relation to the deck by the tension cables 50 which are anchored to the back stay 55 of the stay structure 60. The stay structure 60 is rigidly mounted on the machinery deck 30, and the sheave 45 is rotatably mounted on the upper end of the boom 35.

The dipper 70 is suspended from the boom 35 by the hoist rope(s) 75. The hoist rope 75 is wrapped over the sheave 45 and attached to the dipper 70 at the bail pin 105. The hoist rope 75 is anchored to the winch drum 80 of the machinery deck 30. As the winch drum 80 rotates, the hoist rope 75 is paid out to lower the dipper 70 or pulled in to raise the dipper 70. The dipper handle 85 is also rigidly attached to the dipper 70. The dipper handle 85 is slidably supported in a saddle block 90, and the saddle block 90 is pivotally mounted to the boom 35 at the pivot point 95. The dipper handle 85 includes a rack tooth formation thereon which engages a drive pinion mounted in the saddle block 90. The drive pinion is driven by an electric motor and transmission unit 100 to extend or retract the dipper arm 85 relative to the saddle block 90.

An electrical power source is mounted to the machinery deck 30 to provide power to one or more hoist electric motors for driving the winch drum 80, one or more crowd electric motors for driving the saddle block transmission unit 100, and one or more swing electric motors for turning the turntable 25. Each of the crowd, hoist, and swing motors can be driven by its own motor controller or drive in response to control signals from a controller, as described below.

Figure 2:
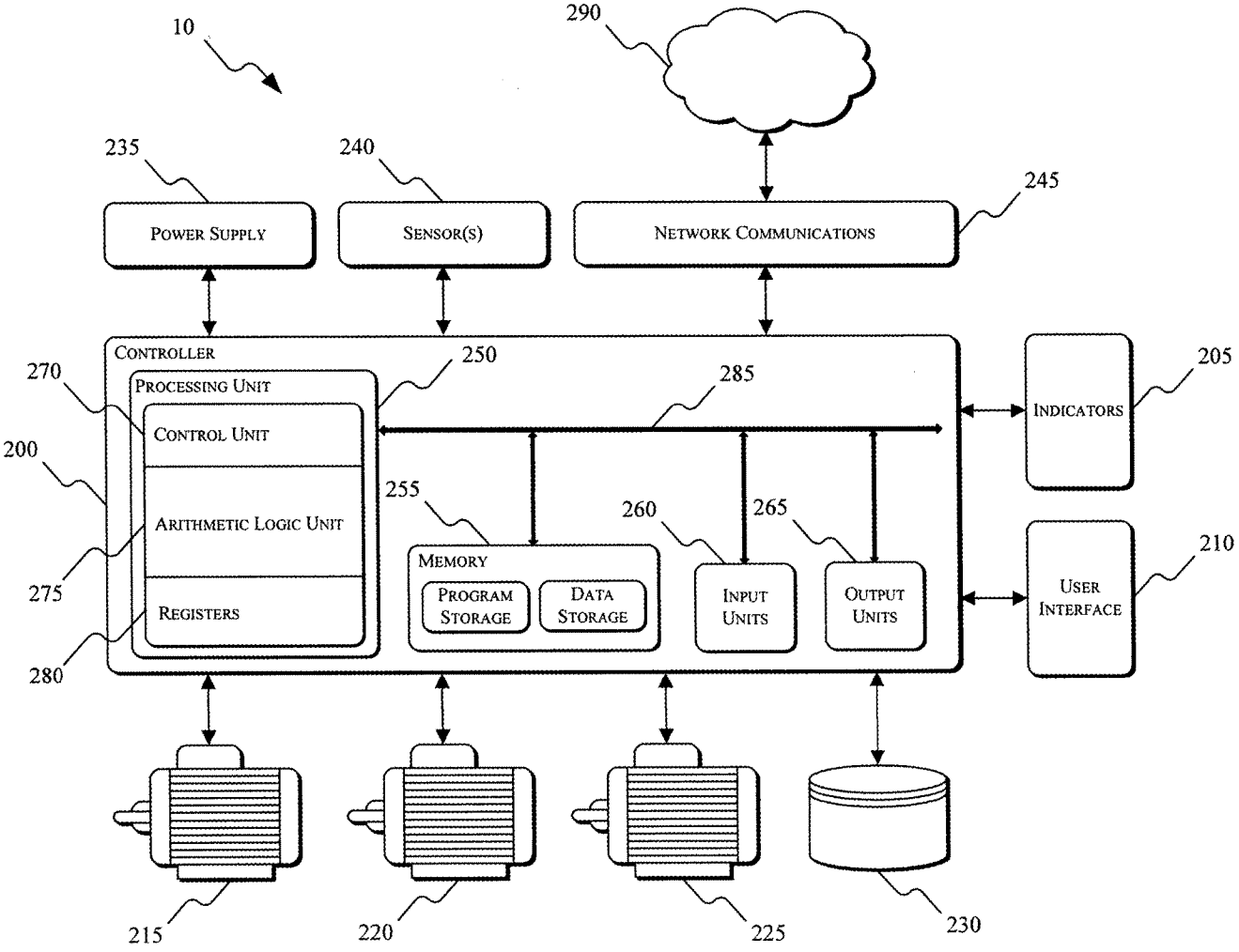
FIG. 2 illustrates a controller for an industrial machine according to an embodiment of the invention.

FIG. 2 illustrates a controller 200 associated with the power shovel 10 of FIG. 1. The controller 200 is electrically and/or communicatively connected to a variety of modules or components of the shovel 10. For example, the illustrated controller 200 is connected to one or more indicators 205, a user interface module 210, one or more hoist motors and hoist motor drives 215, one or more crowd motors and crowd motor drives 220, one or more swing motors and swing motor drives 225, a data store or database 230, a power supply module 235, one or more sensors 240, and a network communications module 245. The controller 200 includes combinations of hardware and software that are operable to, among other things, control the operation of the power shovel 10, control the position of the boom 35, the dipper arm 85, the dipper 70, etc., activate the one or more indicators 205 (e.g., a liquid crystal display ["LCD"]), monitor the operation of the shovel 10, etc. The one or more sensors 240 include, among other things, a loadpin strain gauge, the inclinometer 110, gantry pins, one or more motor field modules, etc. The loadpin strain gauge includes, for example, a bank of strain gauges positioned in an x-direction (e.g., horizontally) and a bank of strain gauges positioned in a y-direction (e.g., vertically) such that a resultant force on the loadpin can be determined.

In some embodiments, the controller 200 includes a plurality of electrical and electronic components that provide power, operational control, and protection to the components and modules within the controller 200 and/or shovel 10. For example, the controller 200 includes, among other things, a processing unit 250 (e.g., a microprocessor, a microcontroller, or another suitable programmable device), a memory 255, input units 260, and output units 265. The processing unit 250 includes, among other things, a control unit 270, an arithmetic logic unit ("ALU") 275, and a plurality of registers 280 (shown as a group of registers in FIG. 2), and is implemented using a known computer architecture, such as a modified Harvard architecture, a von Neumann architecture, etc. The processing unit 250, the memory 255, the input units 260, and the output units 265, as well as the various modules connected to the controller 200 are connected by one or more control and/or data buses (e.g., common bus 285). The control and/or data buses are shown generally in FIG. 2 for illustrative purposes. The use of one or more control and/or data buses for the interconnection between and communication among the various modules and components would be known to a person skilled in the art in view of the invention described herein. In some embodiments, the controller 200 is implemented partially or entirely on a semiconductor (e.g., a field-programmable gate array ["FPGA"] semiconductor) chip, such as a chip developed through a register transfer level ("RTL") design process.

The memory 255 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processing unit 250 is connected to the memory 255 and executes software instructions that are capable of being stored in a RAM of the memory 255 (e.g., during execution), a ROM of the memory 255 (e.g., on a generally permanent basis), or another non-transitory computer readable medium such as another memory or a disc. Software included in the implementation of the shovel 10 can be stored in the memory 255 of the controller 200. The software includes, for example, firmware, one or more applications, program data, filters, rules, one or more program modules, and other executable instructions. The controller 200 is configured to retrieve from memory and execute, among other things, instructions related to the control processes and methods described herein. In other constructions, the controller 200 includes additional, fewer, or different components. The network communications module 245 is configured to connect to and communicate through a network 290. The connections between the network communications module 245 and the network 290 are, for example, wired connections, wireless connections, or a combination of wireless and wired connections. Similarly, the connections between the controller 200 and the network 290 or the network communications module 245 are wired connections, wireless connections, or a combination of wireless and wired connections.

The power supply module 235 supplies a nominal AC or DC voltage to the controller 200 or other components or modules of the shovel 10. The power supply module 235 is powered by, for example, a power source having nominal line voltages between 100V and 240V AC and frequencies of approximately 50-60 Hz. The power supply module 235 is also configured to supply lower voltages to operate circuits and components within the controller 200 or shovel 10. In other constructions, the controller 200 or other components and modules within the shovel 10 are powered by one or more batteries or battery packs, or another grid-independent power source (e.g., a generator, a solar panel, etc.).

The user interface module 210 is used to control or monitor the power shovel 10. For example, the user interface module 210 is operably coupled to the controller 200 to control the position of the dipper 70, the position of the boom 35, the position of the dipper handle 85, the transmission unit 100, etc. The user interface module 210 includes a combination of digital and analog input or output devices required to achieve a desired level of control and monitoring for the shovel 10. For example, the user interface module 210 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. The user interface module 210 can also be configured to display conditions or data associated with the power shovel 10 in real-time or substantially real-time. For example, the user interface module 210 is configured to display measured electrical characteristics of the power shovel 10, the status of the power shovel 10, the position of the dipper 70, the position of the dipper handle 85, etc. In some implementations, the user interface module 210 is controlled in conjunction with the one or more indicators 205 (e.g., LEDs, speakers, etc.) to provide visual or auditory indications of the status or conditions of the power shovel 10.

Figure 3:
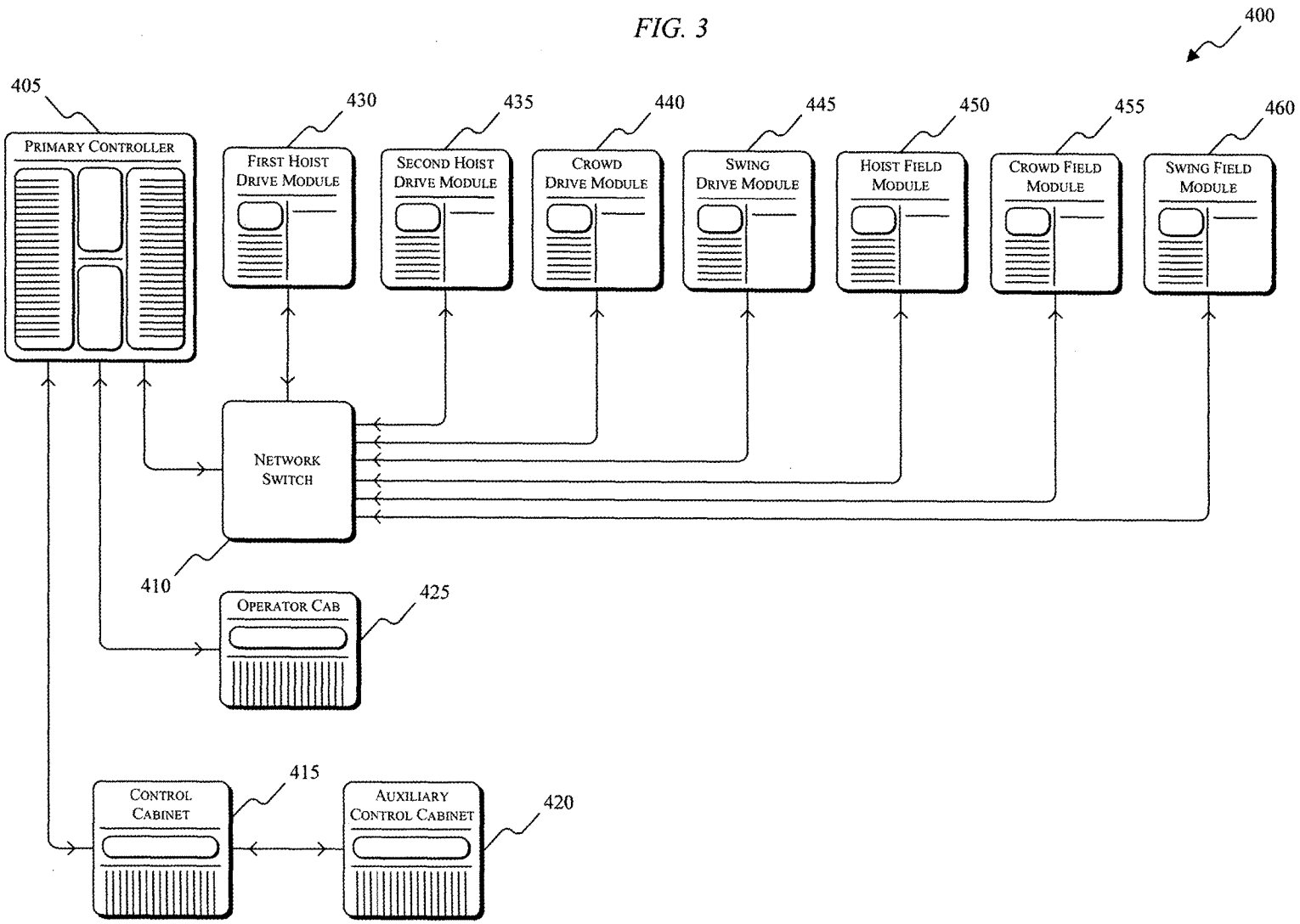
FIG. 3 illustrates a control system for an industrial machine according to an embodiment of the invention.

FIG. 3 illustrates a more detailed control system 400 for the power shovel 10. For example, the power shovel 10 includes a primary controller 405, a network switch 410, a control cabinet 415, an auxiliary control cabinet 420, an operator cab 425, a first hoist drive module 430, a second hoist drive module 435, a crowd drive module 440, a swing drive module 445, a hoist field module 450, a crowd field module 455, and a swing field module 460. The various components of the control system 400 are connected by and communicate through, for example, a fiber-optic communication system utilizing one or more network protocols for industrial automation, such as process field bus ("PROFIBUS"), Ethernet, ControlNet, Foundation Fieldbus, INTERBUS, controller-area network ("CAN") bus, etc. The control system 400 can include the components and modules described above with respect to FIG. 2. For example, the one or more hoist motors and/or drives 215 correspond to first and second hoist drive modules 430 and 435, the one or more crowd motors and/or drives 220 correspond to the crowd drive module 440, and the one or more swing motors and/or drives 225 correspond to the swing drive module 445.

The user interface 210 and the indicators 205 can be included in the operator cab 425, etc. The loadpin strain gauge, the inclinometer 110, and the gantry pins can provide electrical signals to the primary controller 405, the controller cabinet 415, the auxiliary cabinet 420, etc.

The first hoist drive module 430, the second hoist drive module 435, the crowd drive module 440, and the swing drive module 445 are configured to receive control signals from, for example, the primary controller 405 to control hoisting, crowding, and swinging operations of the shovel 10. The control signals are associated with drive signals for hoist, crowd, and swing motors 215, 220, and 225 of the shovel 10. As the drive signals are applied to the motors 215, 220, and 225, the outputs (e.g., electrical and mechanical outputs) of the motors are monitored and fed back to the primary controller 405 (e.g., via the field modules 450-460). The outputs of the motors include, for example, motor speed, motor torque, motor power, motor current, etc. Based on these and other signals associated with the shovel 10 (e.g., signals from the inclinometer 110), the primary controller 405 is configured to determine or calculate one or more operational states or positions of the shovel 10 or its components. In some embodiments, the primary controller 405 or the auxiliary controller cabinet 420 determines a dipper position, a dipper handle angle or position, a hoist wrap angle, a hoist motor rotations per minute ("RPM"), a crowd motor RPM, a dipper speed, a dipper acceleration, etc.

Optimizing the performance of the shovel 10 through a digging operation can improve the payload capacity of the shovel 10 without, for example, increasing structural loading and fatigue on the shovel 10, reducing the operational life of the shovel 10, or increasing the cost of the shovel 10. As an illustrative example, the controller 200 or the primary controller 405 are configured to implement optimized digging control ("ODC") based on a position of the dipper 70, the dipper handle 85, etc. For example, when implementing ODC, the controller 200 is configured to determine the position of the dipper 70 in space or with respect to other components of the shovel 10, and dynamically control hoist forces based on the determined position of the dipper 70. The dynamic control of the hoist forces includes actively controlling a level of hoist bail pull with respect to the position of the dipper 70 as the shovel 10 executes a digging operation. ODC limits the shovel's digging capability at certain areas within the digging envelope 120 (see FIG. 1), but increases the overall load capacity of the shovel 10 with respect to the complete digging operation. For example, ODC is configured to increase hoist bail pull in certain areas of the digging envelope 120, as opposed to limiting hoist bail pull at full extension. In some embodiments, ODC increases hoist bail pull low in the digging envelope 120 and gradually decreases the hoist bail pull higher in the digging envelope 120. As a result of the increase in hoist bail pull, fill factors for the shovel 10 are increased and the digging cycle time of the shovel 10 is decreased (e.g., the dipper 70 is pulled out of the bank sooner). In some embodiments, ODC is also configured to control the hoist bail pull for extended handle reaches to allow the use of a longer dipper handle for extended dumping reaches (e.g., toward a pile, toward a truck, etc.). For example, by enabling the use of a longer dipper handle, the spotting range of a truck can be extended to simplify the loading of large trucks. In some embodiments, ODC utilizes cycle time decomposition to determine whether the shovel 10 has completed a digging operation and allow for extended crowd reach by further limiting hoist bail pull (e.g., below a standard operating value).

Figure 4:
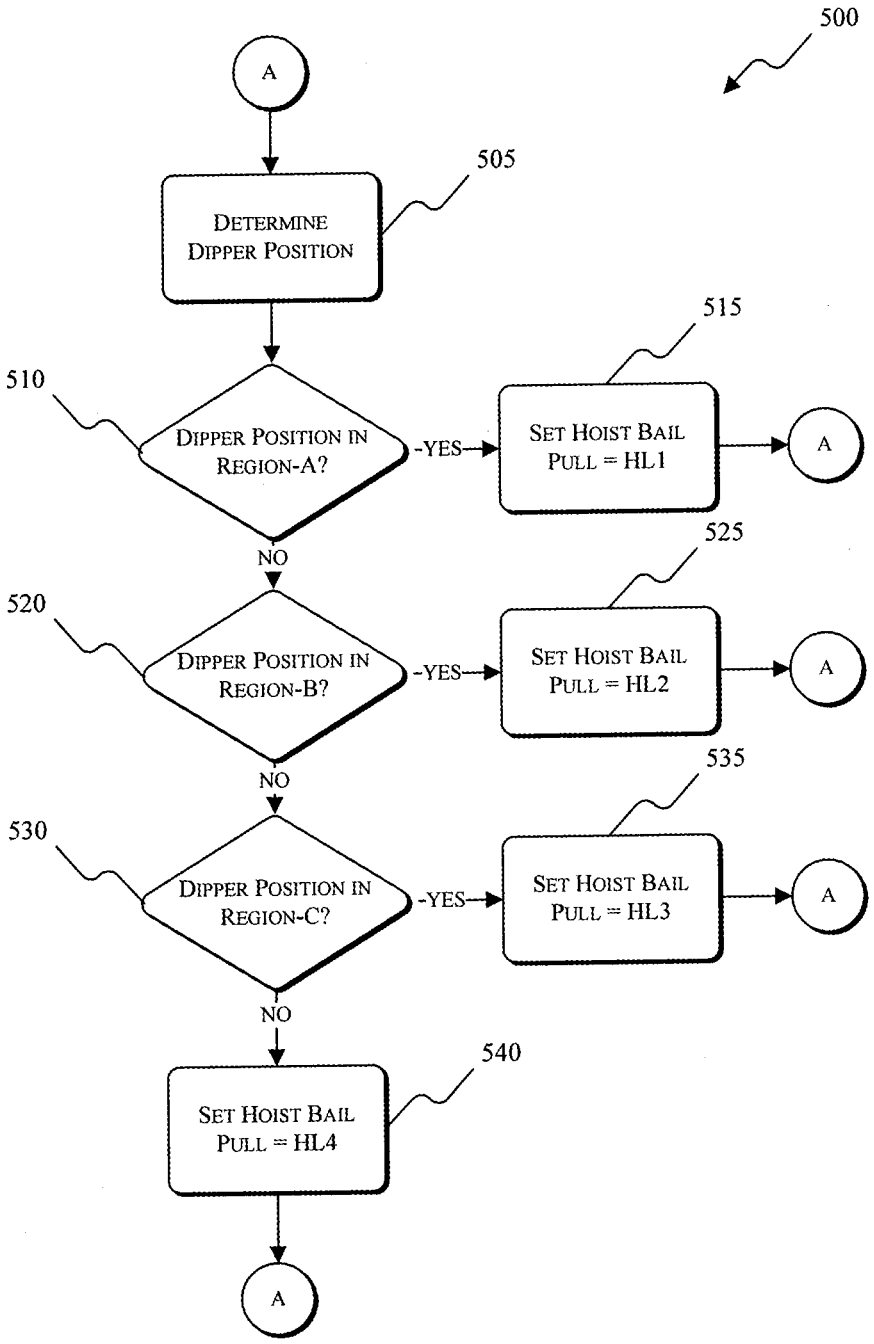
FIG. 4 illustrates a process for controlling an industrial machine according to an embodiment of the invention.

An illustrative example of a process for controlling a level of hoist bail pull with respect to a position of the dipper 70 is shown in and described with respect to FIG. 4. Specifically, FIG. 4 illustrates a process 500 having corresponding computer readable instructions that can be executed by, for example, the controller 200 or the primary controller 405 for controlling a hoist bail pull level based on a position of the dipper 70. At step 505, the position of the dipper 70 is determined. The dipper position is determined based on, for example, the use of one or more resolvers, inclinometers, hoist rope wrap angles, etc. In some embodiments, a position (e.g., a radial position) of the dipper handle 85 is determined using one or more resolvers and is used alone or in combination with the dipper position to control the level of hoist bail pull. After the position of the dipper 70 has been determined, the position of the dipper 70 is compared to REGION-A 125 (see FIG. 1) (step 510). If, at step 510, the position of the dipper 70 is within REGION-A, the hoist bail pull is set to a first hoist limit ("HL1") (step 515). The process 500 then returns to step 505 and section A where the position of the dipper 70 is again determined. If, at step 510, the position of the dipper 70 is not within REGION-A, the process 500 proceeds to step 520. At step 520, if the position of the dipper 70 is within REGION-B 130 (see FIG. 1), the hoist bail pull is set to a second hoist limit ("HL2") (step 525). The process 500 then returns to step 505 and section A where the position of the dipper 70 is again determined. If, at step 520, the position of the dipper 70 is not within REGION-B, the process 500 proceeds to step 530. At step 530, if the position of the dipper 70 is within REGION-C 135 (see FIG. 1), the hoist bail pull is set to a third hoist limit ("HL3") (step 535). The process 500 then returns to step 505 and section A where the position of the dipper 70 is again determined. If, at step 530, the position of the dipper 70 is not within REGION-C, the process 500 proceeds to step 540 where the hoist bail pull is set to a fourth hoist limit ("HL4") (step 540). The process 500 then returns to step 505 and section A where the position of the dipper 70 is again determined. The limits of REGION-A 125, REGION-B 130, and REGION-C 135 can be set, established, or determined based on, for example, the type of industrial machine, the type or model of shovel, etc.

As described in the illustrative example above, the digging envelope 120 of the shovel 10's digging operation is divided into three sections that correspond to REGION-A 125, REGION-B 130, and REGION-C 135. REGION-A 125 corresponds to the lowest or inner portion of the digging envelope 120 of the digging operation and has the largest relative hoist bail pull setting with respect to the remaining regions. REGION-B 130 is adjacent to REGION-A 125 in the digging envelope 120 and has a lower hoist bail pull setting than REGION-A 125, but a larger hoist bail pull setting that REGION-C 135. REGION-C 135 corresponds to the highest or outer portion of the digging envelope 120 of the digging operation and has the lowest hoist bail pull setting with respect to the other regions.

The hoist bail pull limits HL1, HL2, HL3, and HL4 corresponding to the regions of the digging envelope 120 can be set to a variety of values or levels for the hoist drive modules 430 and 435. As an illustrative example, HL1, HL2, HL3, and HL4 decrease from a level that exceeds a standard hoist bail pull (e.g., hoist bail pull≈120% of the standard hoist bail pull) to the standard hoist bail pull that corresponds to a normal maximum operational value (e.g., a rated value) for the hoist bail pull (i.e., ≈100%). In one embodiment, HL1≈120%, HL2≈110%, HL3≈100%, and HL4≈100%. In some embodiments, HL4 can be set to a value below approximately 100% hoist bail pull to enable the use of a longer dipper handle with the shovel 10. In other embodiments, HL1, HL2, HL3 and HL4 can take on different values. However, regardless of the specific values or ranges of values that HL1, HL2, HL3, and HL4 take on, the relationship between the relative magnitudes of the limits remain the same (e.g., HL1>≈HL2>≈HL3>≈HL4). In some embodiments, each of the hoist bail pull limits HL1, HL2, HL3, and HL4 produce approximately the same forward tipping moment and CG excursion on the shovel 10. In some embodiments, the hoist bail pull can also be set to greater than approximately 120% of the normal operation limit for hoist bail pull. In such embodiments, the hoist bail pull is limited to, for example, operational characteristics of the one or more hoist motors 215 (e.g., some motors can allow for greater excess hoist bail pull than others). As such, the hoist bail pull is capable of being set to a value of between approximately 75% and 150% of the normal operational limit based on the characteristics of the one or more hoist motors 215.

By increasing the hoist bail pull low in the digging envelope, the dipper 70 generates a greater payload early in the digging operation and increases the cutting force applied to, and the speed at which the dipper 70 cuts through, the bank early in the digging operation. Gantry pin load and other structural loading also increases with increased payload. However, as a result of the hoist bail pull being increased low in the digging envelope and reduced to approximately the standard operational value higher in the digging envelope, the tipping moment resulting from the digging operation produces a CG excursion of the shovel 10 that is no greater than (i.e., less than or approximately equal to) the CG excursion that would be experienced by the shovel 10 had the hoist bail pull remained at the standard operational value throughout the digging operation.

In some embodiments, the digging envelope 120 is divided into additional (e.g., more than three) or fewer (i.e., two) sections for which the level of hoist bail pull is modified. In embodiments of the invention in which the digging envelope 120 is divided into more than three sections, the number of sections that can be used can be substantially larger than three (e.g., several hundred). For example, the greater the number of sections that the digging envelope 120 is divided into, the more precise and gradual the modification of the hoist bail pull setting becomes. In some embodiments, the number of sections for which the digging envelope 120 is divided is based on the level of precision for which the hoist bail pull can be controlled. In other embodiments, the digging envelope is not divided into sections. Instead, a function is used to calculate a hoist bail pull setting based on the determined position of the dipper 70 or dipper handle 85. In such embodiments, the modifications that can be made to the hoist bail pull setting are substantially continuous. In other embodiments, a look-up table ("LUT") can be used to look up a hoist bail pull setting based on a determined or calculated position of the dipper 70 or dipper handle 85.

Figure 5:
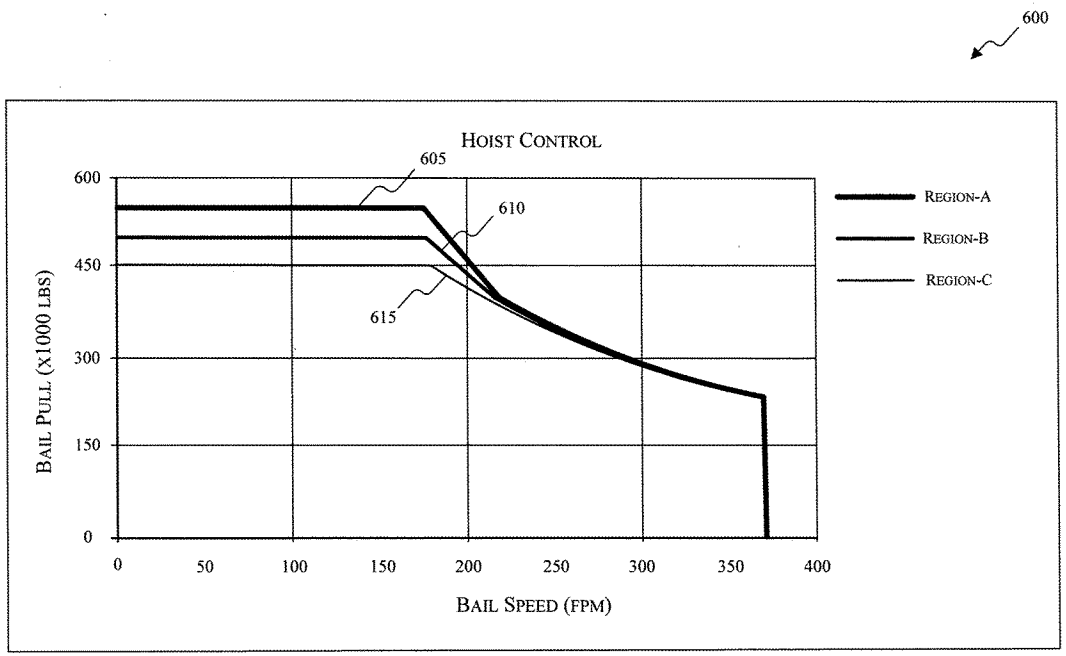
FIGS. 5-8 are diagrams showing relationships between hoist bail pull and bail speed.
Figure 6:
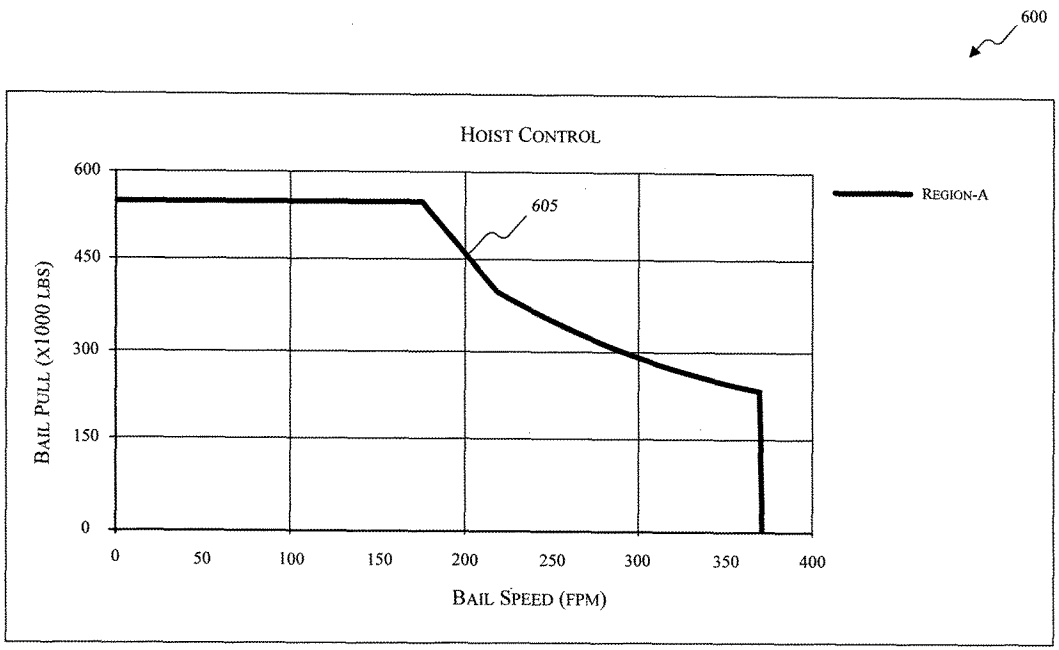
Figure 7:
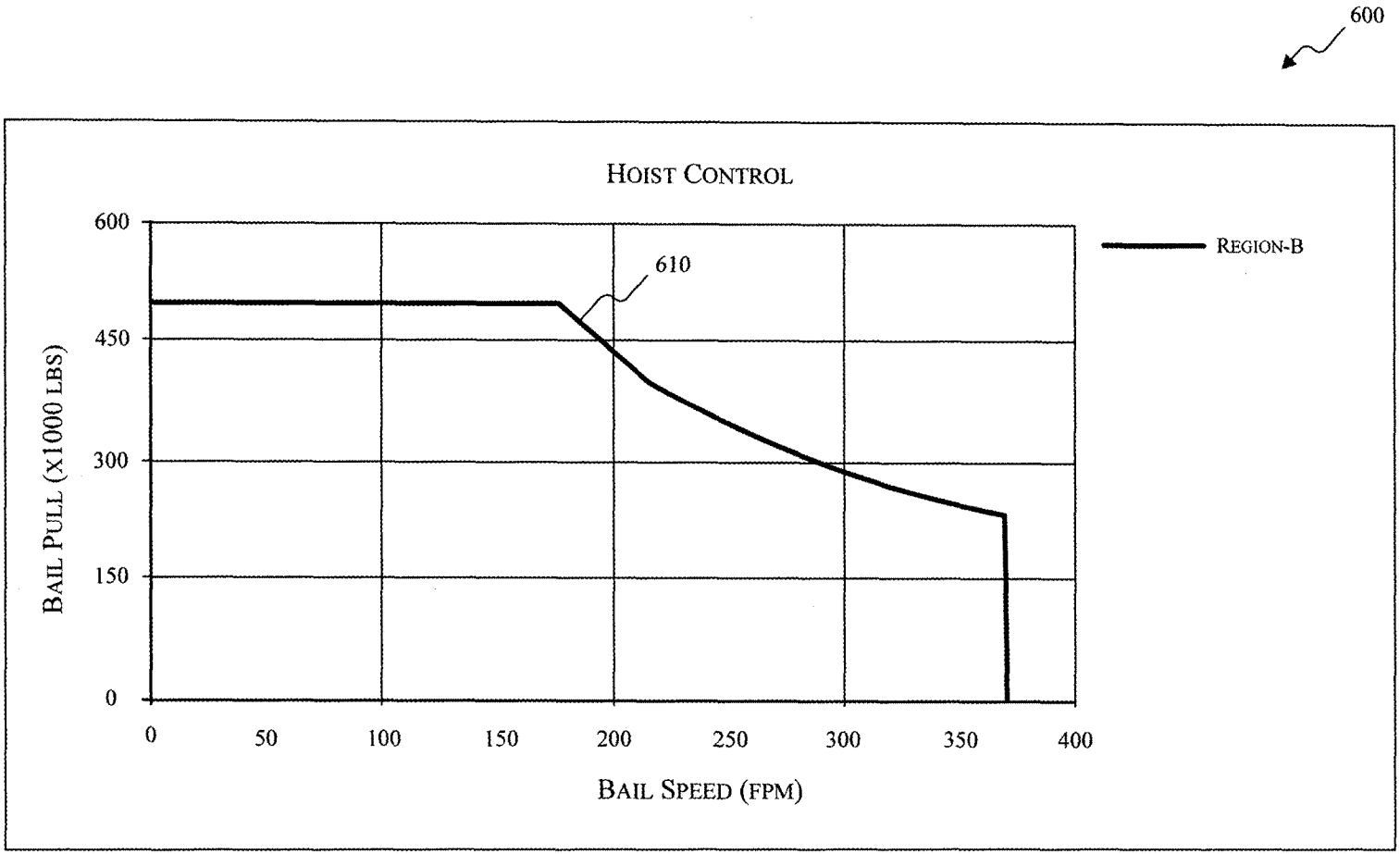
Figure 8:
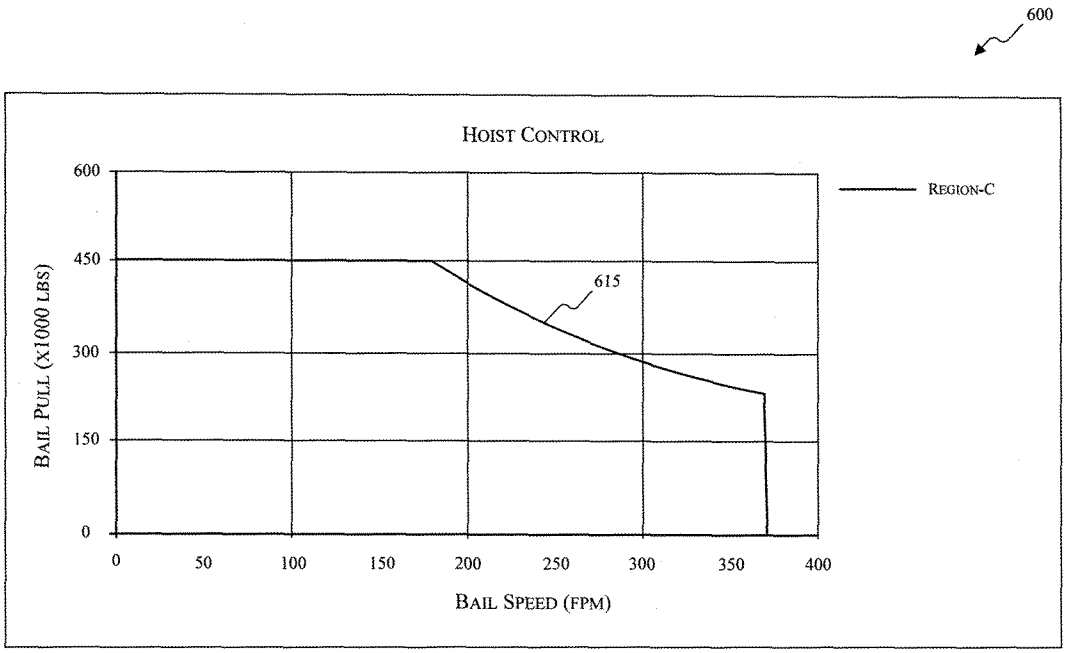

FIGS. 5-8 illustrate hoist bail pull vs. bail speed curves for an embodiment of the invention that includes three regions for which the hoist bail pull is set or modified. FIG. 5 illustrates curves 605, 610, and 615 for each of REGION-A 125, REGION-B 130, and REGION-C 135, respectively, described above. FIGS. 6-8 illustrate the individual curves 605, 610, and 615 corresponding to each of REGION-A 125, REGION-B 130, and REGION-C 135, respectively. As illustrated in FIGS. 5-8, the largest relative hoist bail pull is provided in REGION-A 125. The level of hoist bail pull is set to a lower level for REGION-B 130 and REGION-C 135. For bail speeds that are below approximately 175 feet per minute ("FPM"), the intervals for hoist bail pull settings are substantially constant (i.e., linear). As the bail speed increases, the levels of hoist bail pull in each of the regions is gradually reduced (e.g., as a function of maximum horsepower ["HP"]) until a speed is achieved for which the levels of hoist bail pull in each of the regions is approximately the same. Such a condition is uncommon due to the resistance the dipper 70 encounters when digging a bank. In general, the resistance provided by the bank during a digging operation often prevents the bail speed from increasing substantially beyond the linear portion of the illustrated torque-speed curves.

Although the torque speed curves provided in FIGS. 5-8 are shown with a range of hoist bail pull settings between zero and 600 lbs (×1000), the actual hoist bail pull settings can vary depending on, for example, the type, size, or model of shovel, hoist motor HP, etc. For example, in some embodiments, the torque-speed curves range from zero to 800 lbs (×1000), zero to 1000 lbs (×1000), etc. The levels of hoist bail pull for each of the regions can also be set based on, among other things, digging conditions, shovel model, shovel type, shovel age, dipper type, etc. For example, in one embodiment, the hoist bail pull in REGION-C 135 is set to 500 lbs (×1000), the hoist bail pull in REGION-B 130 is set to 550 lbs (×1000), and the hoist bail pull in REGION-A 125 is set to 600 lbs (×1000). However, such levels of hoist bail pull are exemplary and can vary from one embodiment of the invention to another.

Thus, the invention provides, among other things, systems, methods, devices, and computer readable media for controlling a digging operation of an industrial machine. Various features and advantages of the invention are set forth in the following claims.

What is claimed is:

1. A controller including a processor and executable instructions stored in a non-transitory computer readable medium, the controller operable to retrieve from the memory and execute the instructions to:

determine, using the processor, a first hoist setting when a component of an industrial machine is at a first position during a digging operation;

set, using the processor, a first level of hoist force for a hoist drive to the first hoist setting;

determine, using the processor, a second hoist setting when the component of the industrial machine is at a second position during the digging operation, the first position of the component corresponding to an earlier position in the digging operation than the second position of the component; and set, using the processor, a second level of hoist force for the hoist drive to the second hoist setting, wherein the first level of hoist force is greater than the second level of hoist force, and the first level of hoist force exceeds a normal operating value for hoist force.

2. The controller of claim 1, wherein the industrial machine is a rope shovel.

3. The controller of claim 1, wherein the second level of hoist force corresponds to the normal operating value for hoist force.

4. The controller of claim 3, wherein a tipping moment of the industrial machine at the first position is approximately equal to the tipping moment of the industrial machine at the second position.

5. The controller of claim 4, further operable to retrieve from the memory and execute the instructions to monitor the tipping moment of the industrial machine during the digging operation.

6. The controller of claim 1, wherein the hoist drive is a hoist motor drive.

7. A controller including a processor and executable instructions stored in a non-transitory computer readable medium, the controller operable to retrieve from the memory and execute the instructions to:

determine, using the processor, an operational state associated with an industrial machine during a digging operation based on signals from a plurality of sensors;

determine, using the processor, a first hoist force setting for a hoist drive based on the operational state associated with the industrial machine; and set, using the processor, a first level of hoist force for the hoist drive to the first hoist force setting, wherein, low in a digging envelope of the digging operation, the first level of hoist force exceeds a normal operating value for hoist force.

8. The controller of claim 7, wherein the plurality of sensors includes a strain gauge.

9. The controller of claim 7, wherein the hoist drive is a hoist motor drive.

10. The controller of claim 7, further operable to retrieve from the memory and execute the instructions to determine a second operational state associated with the industrial machine during the digging operation based on signals from the plurality of sensors;

determine a second hoist force setting for the hoist drive based on the second operational state associated with the industrial machine; and set, to the second hoist force setting, a second level of hoist force for the hoist drive, wherein the second level of hoist force is less than the first level of hoist force.

11. The controller of claim 10, wherein the first hoist force setting for the hoist drive corresponds to a component of the industrial machine being at a first position during the digging operation, and wherein the second hoist force setting for the hoist drive corresponds to the component of the industrial machine being at a second position during the digging operation.

12. The controller of claim 11, wherein a tipping moment of the industrial machine at the first position is approximately equal to the tipping moment of the industrial machine at the second position.

13. The controller of claim 12, further operable to retrieve from the memory and execute the instructions to monitor the tipping moment of the industrial machine during the digging operation.

14. The controller of claim 13, wherein the industrial machine is a rope shovel.

15. A control system for an industrial machine, the control system comprising:

a plurality of sensors;

a hoist drive operable to generate a signal related to a hoist force to be applied to a component of the industrial machine as the component is moved through a digging operation;

a controller connected to the hoist drive, the controller including a processor and executable instructions stored in a non-transitory computer readable medium, the controller operable to retrieve from the memory and execute the instructions to determine an operational state associated with the industrial machine during the digging operation based on signals from the plurality of sensors, determine a first hoist force setting for the hoist drive based on the operational state associated with the industrial machine, and set, to the first hoist force setting, a first level of hoist force for the hoist drive, wherein, low in a digging envelope of the digging operation, the first level of hoist force exceeds a normal operating value for hoist force; and a hoist actuator operable to receive the drive signal from the hoist drive based on the first level of hoist force and generate the hoist force that is applied to the component of the industrial machine, the generated hoist force being limited to the first level of hoist force.

16. The control system of claim 15, wherein the plurality of sensors includes a strain gauge.

17. The control system of claim 15, wherein the hoist drive is a hoist motor drive.

18. The control system of claim 17, wherein the hoist actuator is a hoist motor and the hoist force is a hoist motor torque generated by the hoist motor.

19. The control system of claim 18, wherein the hoist motor torque drives a winch drum to pay out or pull in a hoist rope to lower or raise the component.

20. The control system of claim 15, wherein the controller is further operable to retrieve from the memory and execute the instructions to determine a second operational state associated with the industrial machine during the digging operation based on signals from the plurality of sensors;

determine a second hoist force setting for the hoist drive based on the second operational state associated with the industrial machine; and set, to the second hoist force setting, a second level of hoist force for the hoist drive, wherein the second level of hoist force is less than the first level of hoist force.

21. The control system of claim 20, wherein the hoist actuator is further operable to receive a second drive signal from the hoist drive based on the second level of hoist force and generate a second hoist force that is applied to the component of the industrial machine, the generated second hoist force being limited to the second level of hoist force.

22. The control system of claim 21, wherein the first hoist force setting for the hoist drive corresponds to the component of the industrial machine being at a first position during the digging operation, and wherein the second hoist force setting for the hoist drive corresponds to the component of the industrial machine being at a second position during the digging operation.

23. The control system of claim 22, wherein a tipping moment of the industrial machine at the first position is approximately equal to the tipping moment of the industrial machine at the second position.

24. The control system of claim 23, wherein the controller is further operable to retrieve from the memory and execute the instructions to monitor the tipping moment of the industrial machine during the digging operation.

25. The control system of claim 24, wherein the industrial machine is a rope shovel.

* * * * *